US007234179B2

(12) United States Patent
Shaw

(10) Patent No.: US 7,234,179 B2
(45) Date of Patent: Jun. 26, 2007

(54) ROCKING BED

(76) Inventor: Chun-Fa Shaw, 1F, No. 5, Lane 33, Renfu 4th St., Jhongli City, Taoyuan Hsien (TW)

( * ) Notice: Subject to any disclaimer, the term of this patent is extended or adjusted under 35 U.S.C. 154(b) by 181 days.

(21) Appl. No.: 11/023,461

(22) Filed: Dec. 29, 2004

(65) Prior Publication Data

US 2006/0137096 A1 Jun. 29, 2006

(51) Int. Cl.
*A47C 9/02* (2006.01)

(52) U.S. Cl. ..... 5/609; 5/607

(58) Field of Classification Search ..... 5/607–610, 5/108–109

See application file for complete search history.

(56) References Cited

U.S. PATENT DOCUMENTS 3,529,311 A * 9/1970 Crawford ..... 5/109

4,969,451 A * 11/1990 Totten ..... 601/53

* cited by examiner

*Primary Examiner*—Patricia Engle
*Assistant Examiner*—Fredrick Conley
(74) *Attorney, Agent, or Firm*—Rosenberg, Klein & Lee

(57) ABSTRACT

A rocking assembly for a bed has a mattress frame, a base frame and a rocking driver. The base frame supports the mattress frame. The rocking driver is mounted on the base frame and has a motor, a flywheel and a connecting rod. The flywheel is rotated by the motor. The connecting rod is connected eccentrically to the flywheel and pivotally to the mattress frame. When the motor turns, the connecting rod rocks the mattress frame so a person lying on the bed rocks from side to side and pressure on individual parts of the person's body is alleviated so blood can circulate to the areas and bedsores will not develop.

3 Claims, 7 Drawing Sheets

ROCKING BED

BACKGROUND OF THE INVENTION

1. Field of the Invention

The present invention relates to a bed, and more particularly to a rocking bed.

2. Description of Related Art

Bedsores are very common among people who are bedridden for a long time, such as people with extended debilitating illnesses and people in comas or vegetative states. Bedsores are caused by a particular part of a person's body being in contact with a bed so long that circulation is restricted and infection sets in.

To overcome the shortcomings, the present invention provides a rocking bed to obviate or mitigate the aforementioned problems.

SUMMARY OF THE INVENTION

The primary objective of the present invention is to provide a rocking bed that shifts a person in the bed and alleviate pressure so bedsores are either prevented or less likely to develop.

The rocking bed in accordance with the present invention comprises a mattress frame, a base frame, a rocking driver, an optional segmented bedboard and an optional elevation driver. The base frame pivotally supports the mattress frame. The rocking driver is mounted on the base frame and has a motor, a flywheel and a connecting rod. The flywheel is connected to and rotated by the motor. The connecting rod is connected eccentrically to the flywheel and pivotally to the mattress frame. When the motor turns, the connecting rod rocks the mattress frame so a person lying on the bed rocks from side to side and pressure on individual parts of the person's body is alleviated so blood can circulate to the areas and bedsores will not develop.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
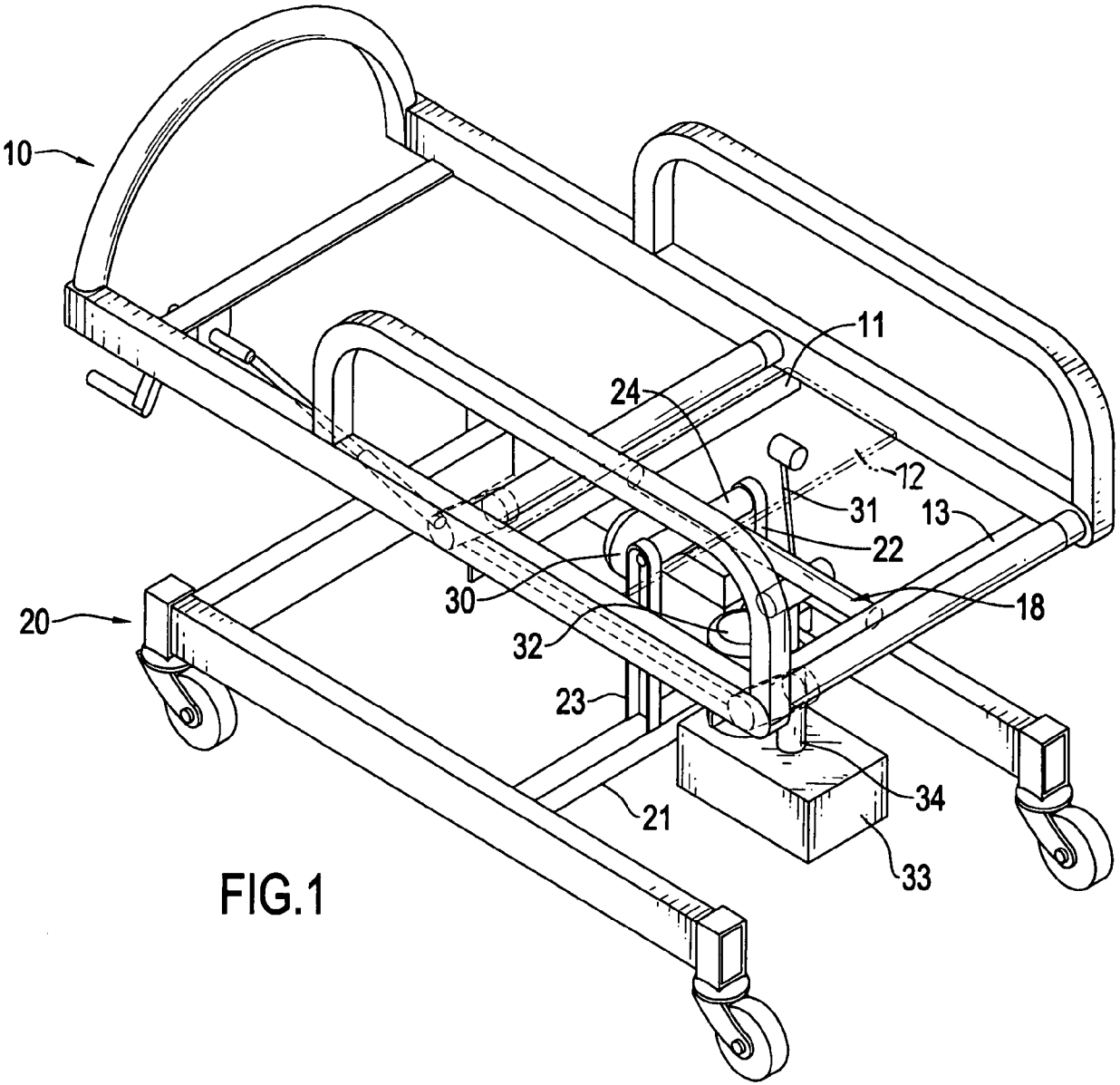
FIG. 1 is perspective view of a rocking bed in accordance with the present invention.
Figure 4:
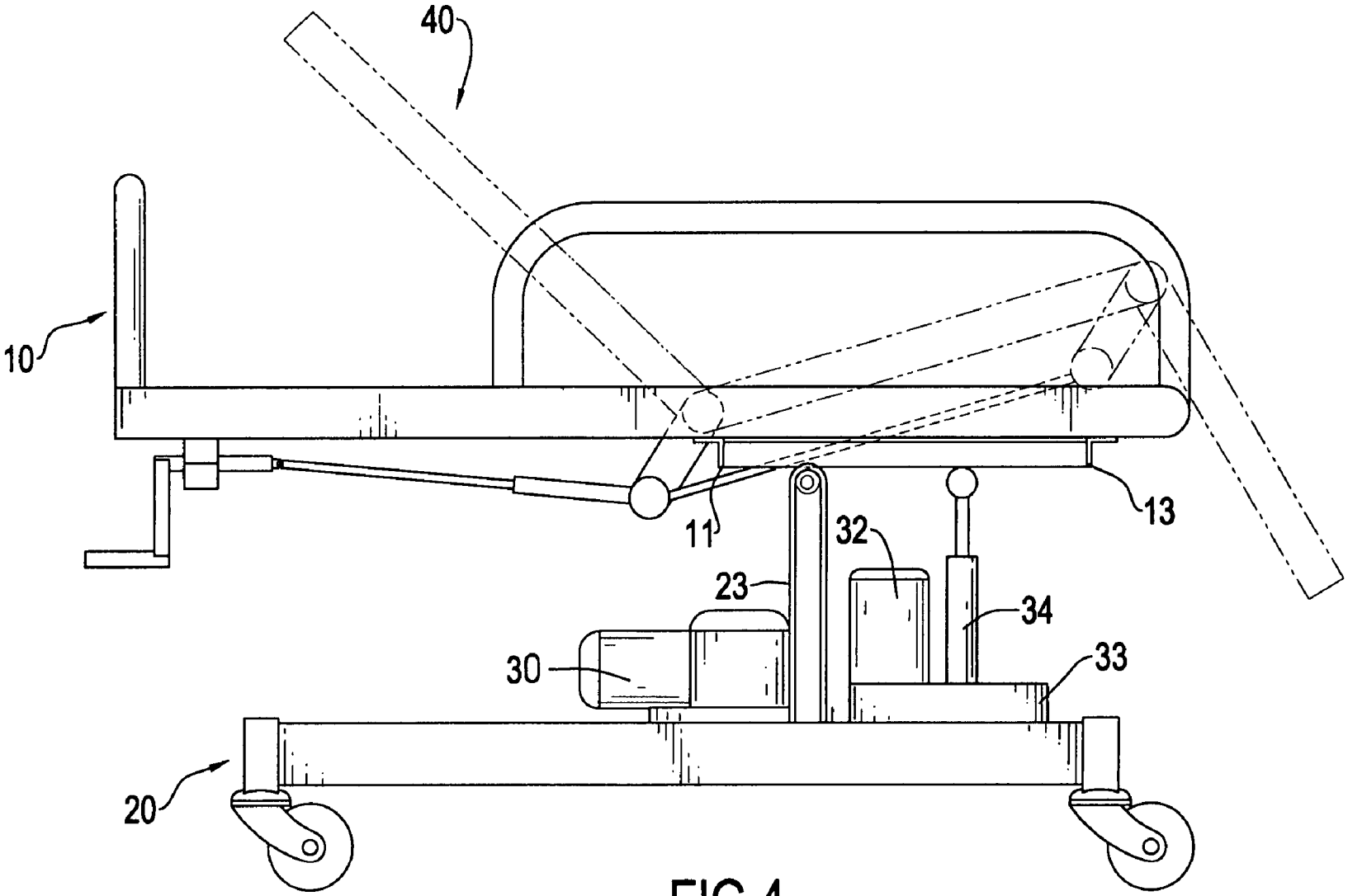
FIG. 4 is a side view of the rocking bed in FIG. 1 with a rising segmented bedboard.

With reference to FIGS. 1 and 4, a rocking bed in accordance with the present invention comprises a base frame (20), a mattress frame (10), a rocking driver, an optional segmented bedboard (40) and an optional inclining assembly.

Figure 2:
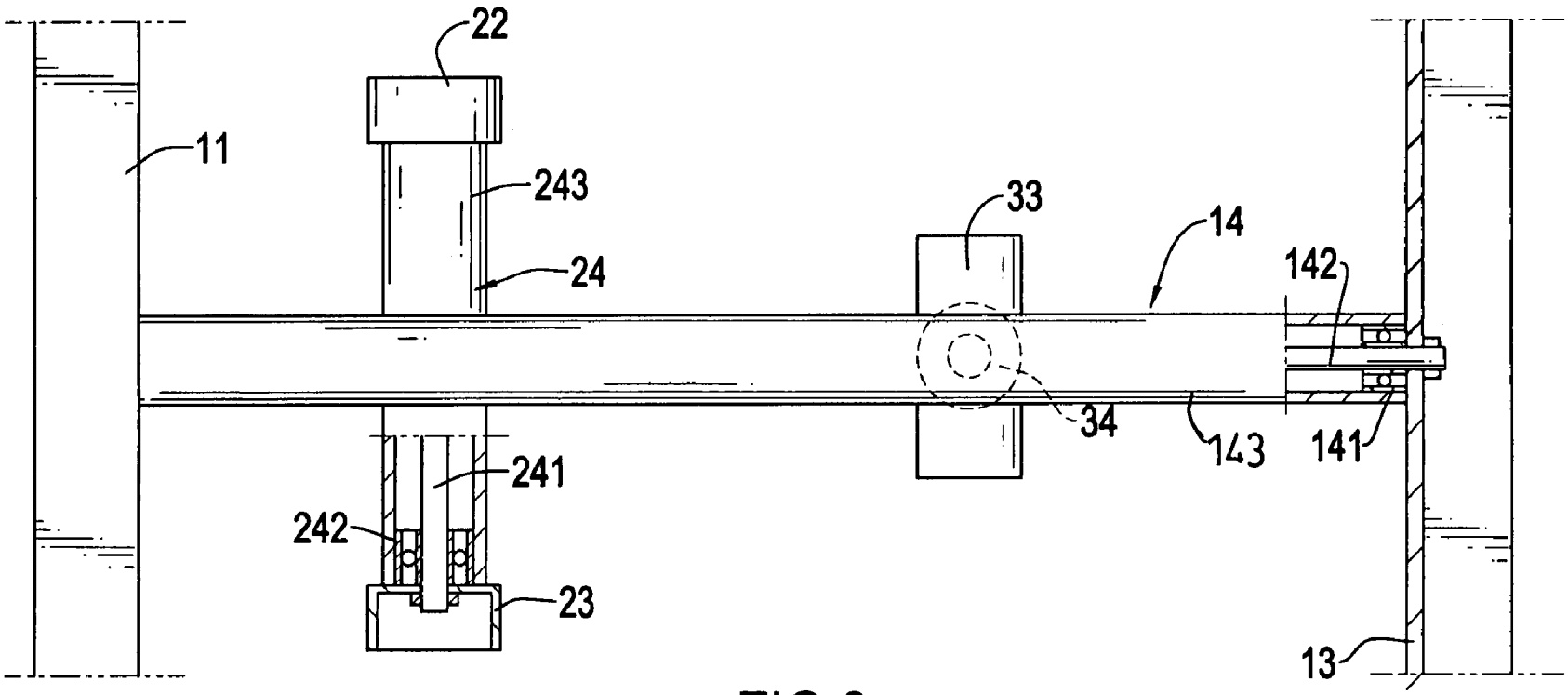
FIG. 2 is a top perspective view in partial section of a mattress frame for the rocking bed in FIG. 1.
Figure 3:
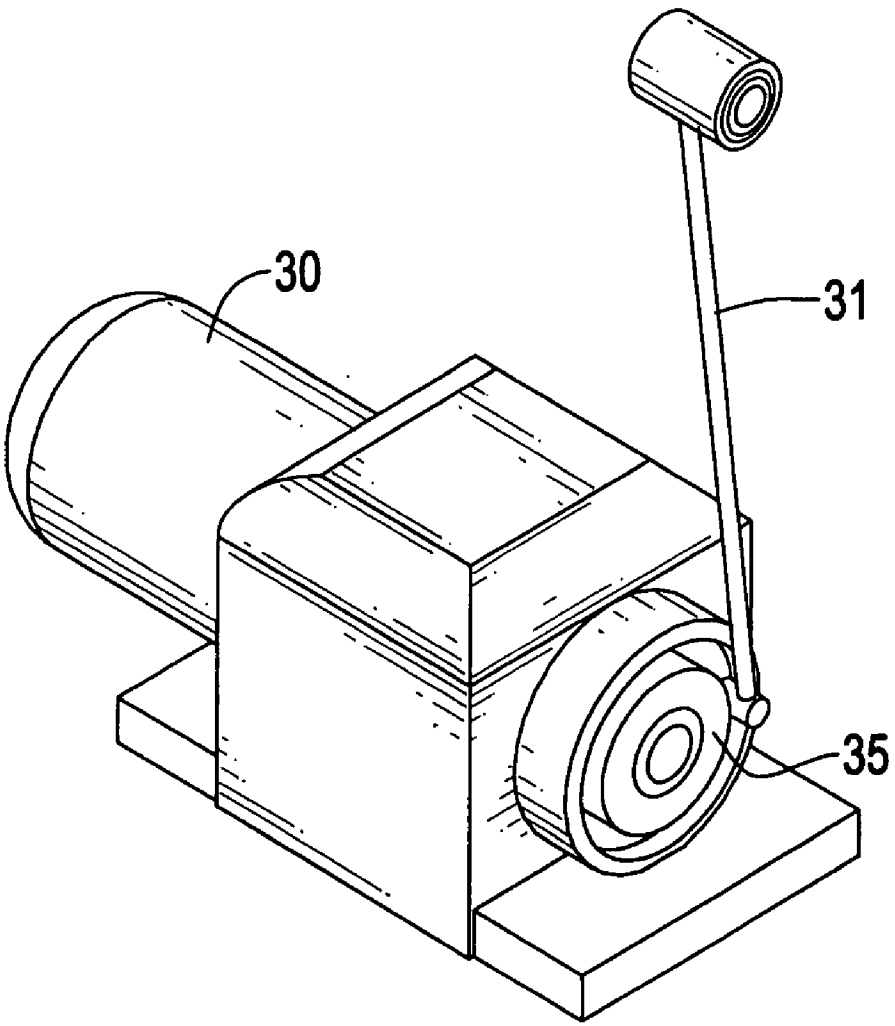
FIG. 3 is a perspective view of a rocking driver for the rocking bed in FIG. 1.

The base frame (20) having multiple transverse members and a mounting bracket. The multiple transverse members include a central transverse member (21). The mounting bracket is mounted on the central transverse member (21) and may be a simple inverted U-shaped bracket or a pivoting bracket assembly. The inverted U-shaped bracket comprises two uprights and a cross-member. With further reference to FIG. 2, the pivoting bracket assembly comprises a left upright (23), a right upright (22) and a rotating cross-member (24). The rotating cross-member (24) comprises an inner shaft (241), two bearings (242) and an outer tube (243). The inner shaft (241) is mounted securely between the uprights (22, 23) and has two ends. The bearings (242) are mounted around the inner shaft (241) respectively near the ends of the inner shaft (241). The outer tube (243) is mounted on the bearings (242) between the uprights (22, 23) and rotates around the inner shaft (241).

The mattress frame (10) is mounted pivotally on the base frame (20) and has multiple transverse members and a rotating longitudinal member (14). The transverse members include an L-shaped foot slat (13), an L-shaped central slat (11) and a flat central slat (12). The rotating longitudinal member (14) is connected to the mounting bracket on the base frame (20), allows the mattress frame (10) to rock relative to the base frame (20) and comprises an inner shaft (142), two bearings (141) and an outer tube (143). The inner shaft (142) is mounted securely between the L-shaped foot slat (13) and the L-shaped central slat (11) and has two ends. The bearings (141) are mounted around the inner shaft (142) respectively near the ends of the inner shaft (142). The outer tube (143) is mounted on the bearings (141) between the L-shaped foot slat (13) and the L-shaped central slat (11), rotates around the inner shaft (142) and is attached to the mounting bracket on the base frame (20). When the inverted U-shaped bracket is installed on the base frame (20), the outer tube (143) is securely attached to the cross-member. When the pivoting bracket assembly is installed on the base frame (20), the outer tube (143) is attached securely to the outer tube (243) of the rotating cross-member (24).

With further reference to FIGS. 3, 6, 7 and 8, the rocking driver is mounted on the base frame (20), rocks the mattress frame (10) relative to the base frame (20) and comprises a motor (30), a flywheel (35) and a connecting rod (31). The motor (30) is mounted on the base frame (20). The flywheel (35) is connected to and rotated by the motor (30). The connecting rod (31) is connected eccentrically to the flywheel (35) and has a top end and a bottom end. The top end of the connecting rod (31) is connected pivotally and off-center to the mattress frame (10). Preferably, the top end of the connecting rod (31) is connected pivotally to the flat central slat (12). The bottom end is connected rotatably to an eccentric point on the flywheel (35), moves up and down and rocks the mattress frame (10) when the flywheel (35) rotates. The rocking mattress frame (10) causes a patient lying in the bed to shift so pressure on specific points on the patient's body is relieved, which obviates or mitigates the development of bedsores.

Figure 5:
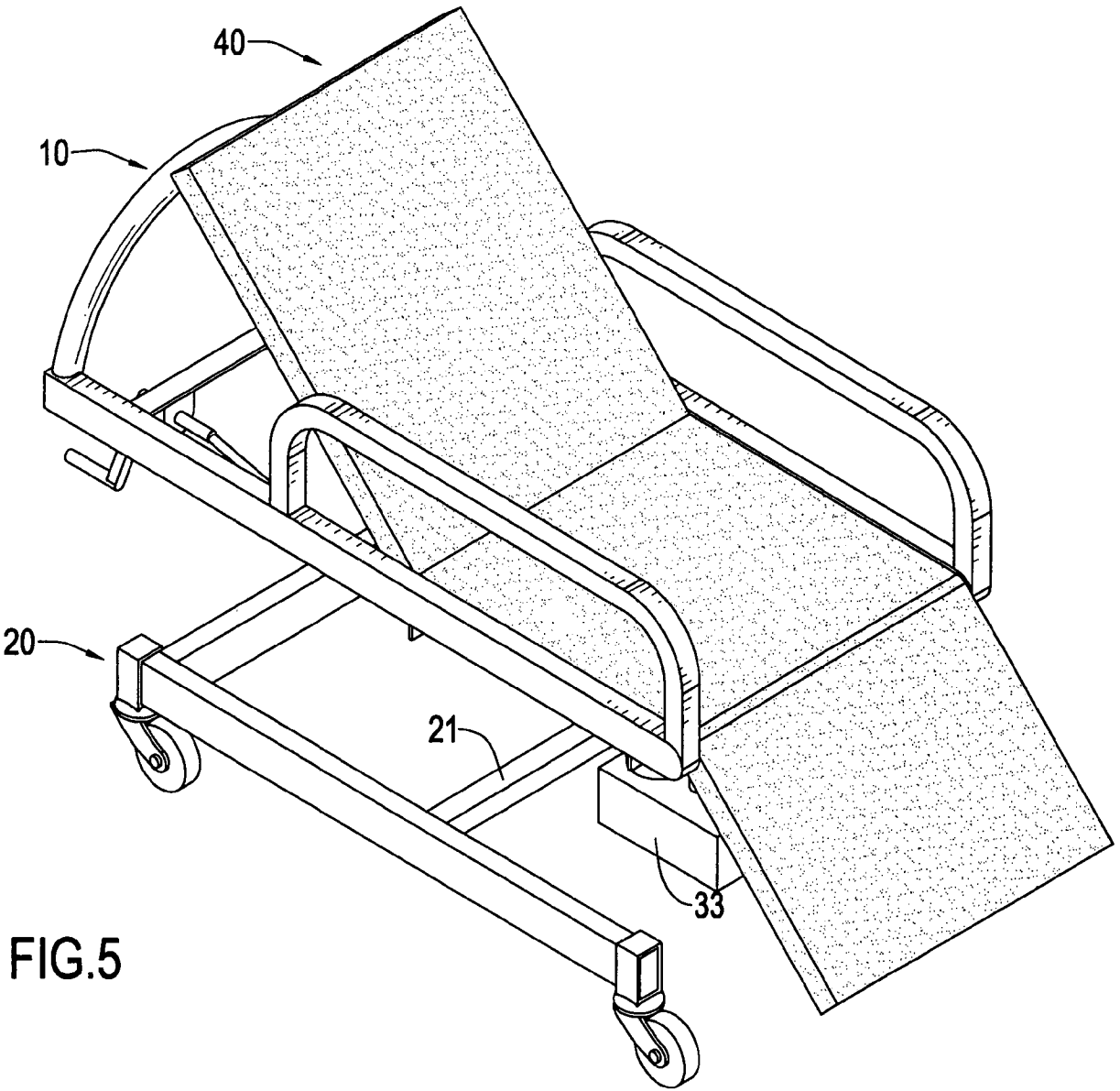
FIG. 5 is a perspective view of the rocking bed in FIG. 4.
Figure 6:
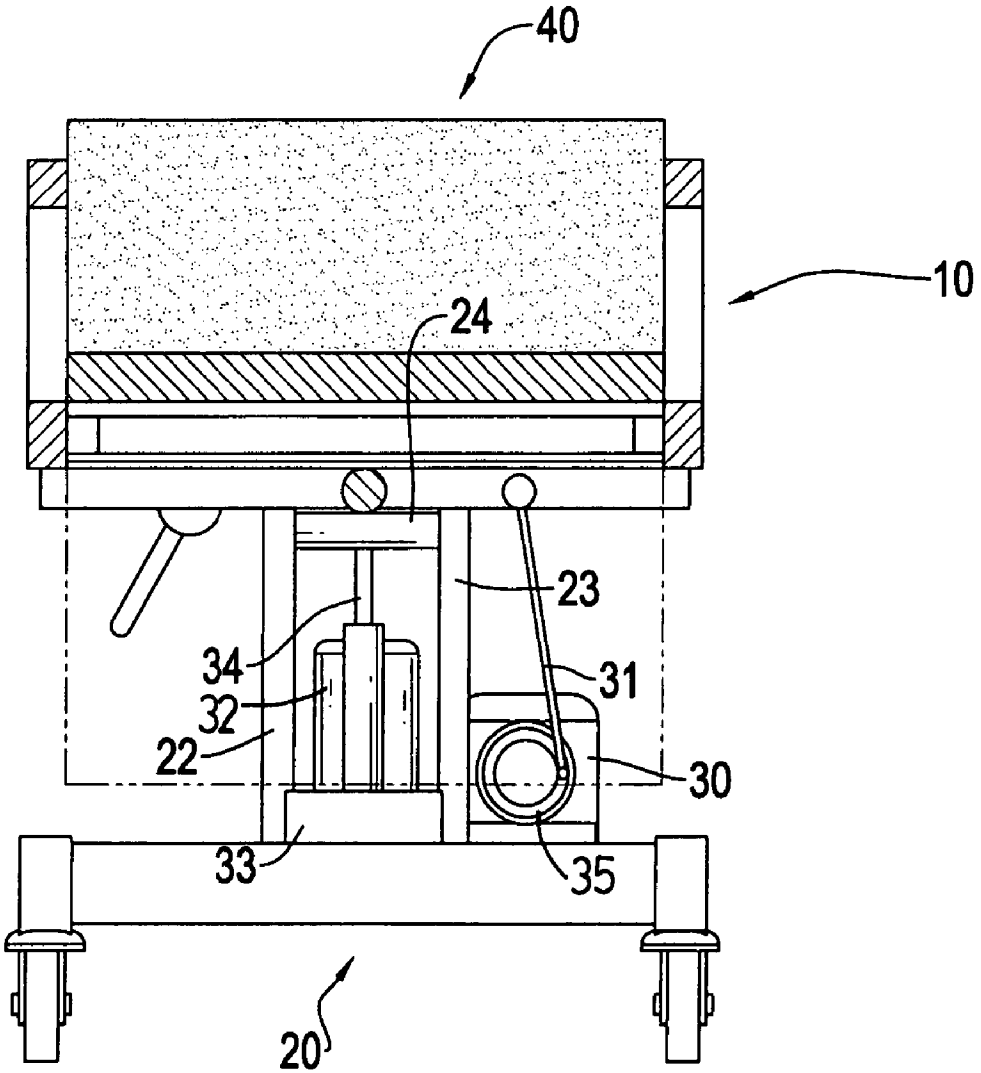
FIG. 6 is a cross sectional end view of the rocking bed in FIG. 5.
Figure 7:
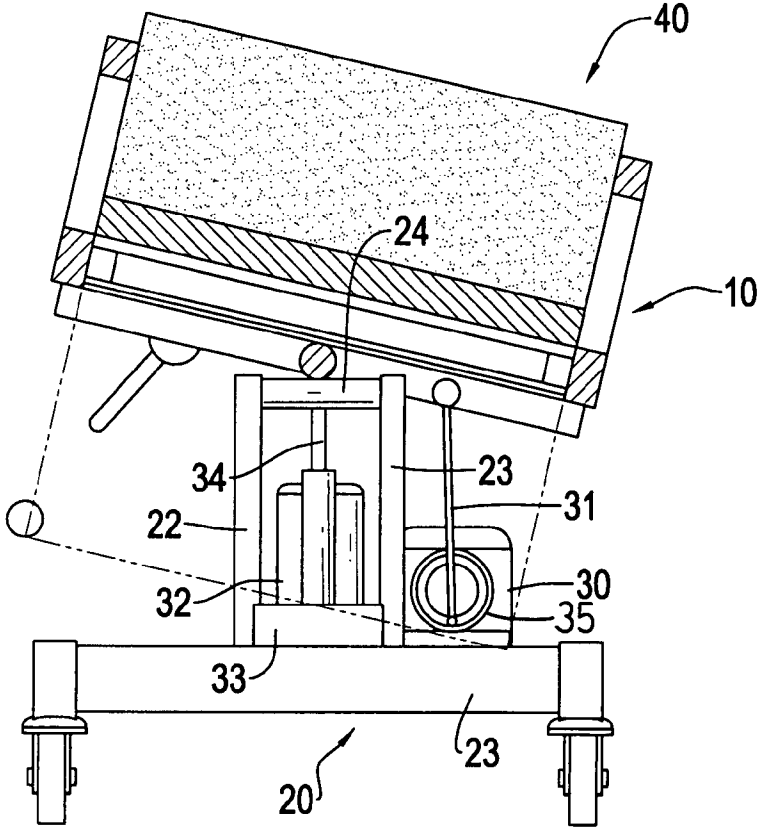
FIG. 7 is an operational cross sectional end view of the rocking bed in FIG. 6.
Figure 8:
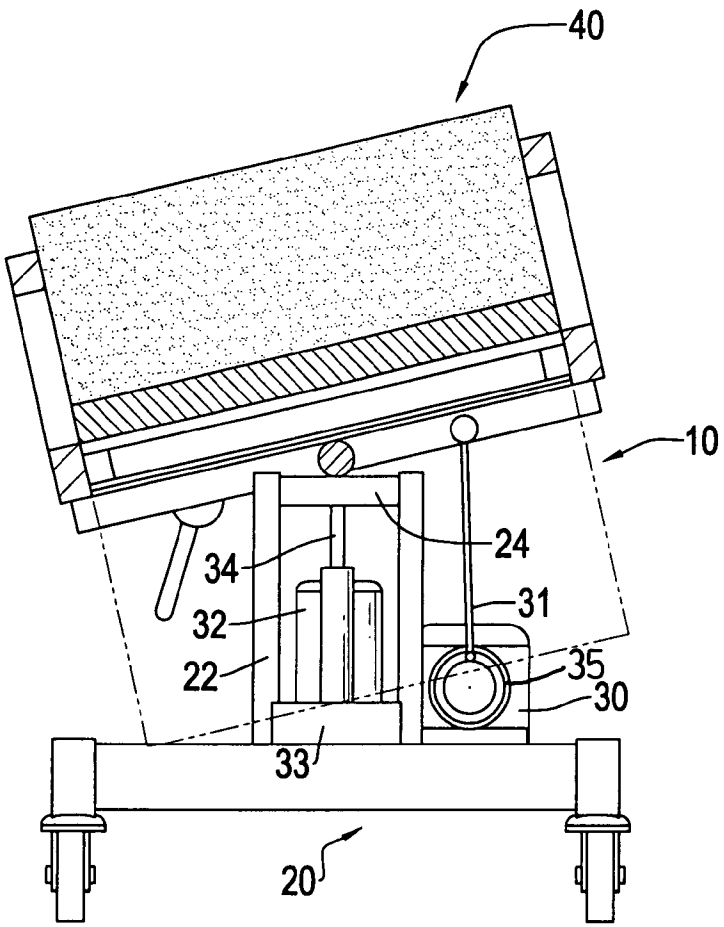
FIG. 8 is an operational cross sectional end view of the rocking bed in FIG. 6.

With further reference to FIG. 5, the optional segmented bedboard (40) may be conventional, is mounted on the mattress frame (10) and selectively holds a person lying in the bed in a sitting or reclining position.

With further reference to FIG. 4, the inclining assembly is mounted on the base frame (20) near the center transverse bar (21) in conjunction with the pivoting bracket assembly and has a motor (32), a gearbox (33) and a drive rod (34). The motor (32) is mounted on the base frame (20). The gearbox (33) is connected to the motor (32). The drive rod (34) is connected to and driven by the gearbox (33) and has a top end. The top end of the drive rod (34) is connected pivotally to the outer tube (143) of the rotating longitudinal member (14) on the mattress frame (10). The drive rod (34) may be a threaded rod mounted on a threaded sleeve that is rotated by the gearbox (33) to make the threaded rod rise or lower when the threaded sleeve is rotated. The drive rod (34) may be an oil-pressured rod and gearbox (33) is an oil container to supply the oil to the drive rod (34) to make it rise and lower. The gearbox (33) may have a flywheel and the drive rod (34) is eccentrically attached to the flywheel, such that the drive rod (34) is driven to rise and lower by the flywheel. When the drive rod (34) is driven by the motor (32), an end of the mattress frame (10) is able to selectively rise and lower.

Therefore, the mattress frame (10) is able to rock from side to side and the end of the mattress frame (10) selectively rises and lowers. The person's body is alleviated so the blood can circulate and the bedsores will not develop.

Even though numerous characteristics and advantages of the present invention have been set forth in the foregoing description together with details of the structure and function of the invention, the disclosure is illustrative only. Changes may be made in detail especially in matters of shape, size, and arrangement of parts within the principles of the invention to the full extent indicated by the broad general meaning of the terms in which the appended claims are expressed.

What is claimed is:

1. A rocking assembly for a bed comprising:

a base frame including:

multiple transverse members including a central transverse member; and a pivoting mounting bracket assembly mounted on the central transverse member including:

a left upright;

a right upright; and a rotating cross-member including:

an inner shaft mounted securely between the uprights and having two ends;

two bearings mounted around the inner shaft respectively near the ends of the inner shaft; and an outer tube mounted on the bearings between the uprights and rotating around the inner shaft;

a mattress frame mounted pivotally on the base frame and having multiple transverse members including:

an L-shaped foot slat;

an L-shaped central slat; and a flat central slat;

a rotating longitudinal member connected to the mounting bracket on the base frame allowing the mattress frame to rock relative to the base frame and comprising:

an inner shaft mounted securely between the L-shaped foot slat and the L-shaped central slat and having two ends;

two bearings mounted around the inner shaft respectively near the ends of the inner shaft; and an outer tube mounted on the bearings between the L-shaped foot slat and the L-shaped central slat, rotating around the inner shaft and attached to the mounting bracket on the base frame, wherein the outer tube of the longitudinal rotating member is attached securely to the outer tube of the rotating cross-member;

a rocking driver mounted on the base frame, rocking the mattress frame relative to the base frame and comprising:

a motor mounted on the base frame;

a flywheel connected to and rotated by the motor; and a connecting rod connected eccentrically to the flywheel and having:

a top end connected pivotally and off-center to the mattress frame; and a bottom end connected rotatably to an eccentric point on the flywheel moving up and down and rocking the mattress frame when the flywheel rotates; and an inclining assembly mounted on the base frame near the center transverse bar and having:

a motor mounted on the base frame;

a gearbox connected to the motor; and a drive rod connected to and driven by the gearbox and having a top end connected pivotally to the outer tube of the rotating longitudinal member.

2. The rocking assembly for the bed as claimed in claim 1, the rocking assembly further comprising a segmented bedboard mounted on the mattress frame.

3. The rocking assembly as claimed in claim 1, wherein the top end of the connecting rod of the rocking driver is connected pivotally to the flat central slat.

* * * * *